United States Patent [19]

Jarrett

[11] Patent Number: 4,472,842

[45] Date of Patent: Sep. 25, 1984

[54] POOL SKIMMER AND METHOD OF USING IT

[76] Inventor: Anna M. Jarrett, 1517 S. Bethel, Sanger, Calif. 93657

[21] Appl. No.: 462,691

[22] Filed: Jan. 31, 1983

[51] Int. Cl.[3] ..... E04H 3/20; E02B 15/04

[52] U.S. Cl. ..... 4/490; 405/63; 405/70

[58] Field of Search ..... 405/63–72; 210/922; 4/490

[56] References Cited

U.S. PATENT DOCUMENTS

| | | | |
|---|---|---|---|
| 2,240,567 | 5/1941 | Meacham et al. | 405/70 X |
| 2,367,997 | 1/1945 | Chambers | 4/490 X |
| 3,321,923 | 5/1967 | Smith et al. | 405/66 |
| 3,539,013 | 11/1970 | Smith | 405/72 |
| 3,563,036 | 2/1971 | Smith et al. | 405/72 X |
| 3,686,870 | 8/1972 | Blomberg | 405/70 |
| 3,762,169 | 10/1973 | Graham | 405/62 |
| 3,766,739 | 10/1973 | MacLean | 405/65 |
| 3,818,708 | 6/1974 | Benson | 405/72 |
| 3,906,732 | 9/1975 | Tedeschi | 405/70 |
| 3,973,406 | 8/1976 | Casey | 405/70 X |
| 4,102,789 | 7/1978 | Young | 405/66 X |
| 4,270,874 | 6/1981 | March et al. | 405/63 |
| 4,300,856 | 11/1981 | Magoon et al. | 405/70 X |

*Primary Examiner*—Dennis L. Taylor

*Attorney, Agent, or Firm*—Huebner & Worrel

[57] ABSTRACT

A pool skimmer having an elongated, floating barrier constructed of a plurality of rigid, elongated floats disposed in end-to-end relation and covered by flexible netting, one end of the barrier having a member for anchoring the one end in engagement with the wall of a swimming pool and the other end of the barrier having manually graspable members for engaging the other end with the wall and for traversing the other end around the wall so that the barrier sweeps the pool surface and collects floating material, such as oil. The barrier has a pleated configuration for expansion and contraction to accommodate varying distances between its ends as the barrier sweeps the pool so as to circumscribe the material and, finally, to assume a fully contracted configuration. The skimmer includes a case which is upwardly open and is downwardly perforated, the case being submerged beneath the barrier and then raised to receive the barrier and lift it and the collected material from the pool.

7 Claims, 10 Drawing Figures

POOL SKIMMER AND METHOD OF USING IT

BACKGROUND OF THE INVENTION

1. Field of the Invention

The present invention relates to a pool skimmer and method of using it, and more particularly to such a skimmer and method for removing undesirable floating materials, especially oil, from the surface of a swimming pool or the like.

2. Description of the Prior Art

As is well known, swimming pools and the like collect undesired floating materials. Particularly undesirable are oily substances which originate from hair oil, tanning lotion, and body oils and which, in themselves, contribute substantially to the contamination of a pool. These substances also combine with other undesirable materials, and the resulting conglomerate, whether remaining afloat or tending to settle on the pool bottom, is a major portion of the matter which must be removed by the usual pool filter or skimmer through which the pool water is circulated. As a result, it is highly desirable to skim oils and oily material from pool surfaces as soon as practical after their deposit therein.

The prior art method of such removal utilizes devices, such as dip nets, manipulated by an elongated handle and constructed of netting having a mesh such that the netting collects oil and other floating materials while allowing pool water to pass. Typically, a suitable proprietary solution is applied to the netting before skimming so as to increase the effectiveness of oil removal. These prior art devices skim only a relatively small area of a pool surface at each insertion so that many repeated insertions of a device into a pool are required to skim the pool completely. This prior art approach to skimming is, therefore, extremely tedious at best. It is also relatively ineffective, since each time the skimming device is lifted from the pool surface any oily film thereon immediately spreads over the area just skimmed even if the surface is quiescent. During windy conditions it is almost impossible effectively to remove floating oil and other materials from an outdoor pool surface by such prior art devices.

It is well known to contain floating oil, such as heavy petroleum oil escaping from tankers or other ships, for subsequent collection by floating barriers of a variety of constructions. However, insofar as known to the applicant such barriers do not themselves collect floating oil but merely contain it for collection by other apparatus. In any event, such barriers known to the applicant are relatively expensive and unwieldy and are thus unsuited for use in skimming small quantities of relatively thin oils and other materials from a swimming pool.

PRIOR ART STATEMENT

The following patents, copies of which are enclosed together with Form PTO-1449, are submitted in conformance with 37 C.F.R. §1.97 and §1.98 and characterize, together with the prior art discussed above, the closest prior art of which the applicant is aware:

Graham—3,762,169—Oct. 2, 1973
MacLean—3,766,739—Oct. 23, 1973
Benson—3,818,708—June 25, 1974
Tedeschi—3,906,732—Sept. 23, 1975
March et al—4,270,874—June 2, 1981

The Graham Pat. No. 3,762,169 is believed relevant in its disclosure of an elongated, flexible element having floats spaced therealong and controlled by cables at each end to circumscribe an oil slick.

Pat. No. 3,766,739 to MacLean is believed relevant in its disclosure of an elongated closure device which is for use with floating oil and which has a plurality of segments disposed in end-to-end pleated configuration for lengthwise expansion and contraction of the device.

The Benson Pat. No. 3,818,708 is believed relevant in its disclosure of a floating barrier having sections which are hinged to each other and are individually floated by foam filled tubes.

The Tedeschi Pat. No. 3,906,732 is believed relevant in disclosing an elongated, floating oil barrier seal which has floats spaced along it and weights disposed downwardly of it, the barrier being contractible and expansible by portions having a pleated configuration and being moored by lines.

Pat. No. 4,270,874 to March et al is believed relevant in its disclosure of a containment boom having an elongated flexible panel provided with a plurality fo floats spaced longitudinally therealong and with a plurality of ballast weights along the bottom of the panel.

SUMMARY OF THE INVENTION

It is an object of the subject invention to provide an improved pool skimmer for removing undesired floating materials, particularly oil or other oleaginous material, from a pool surface.

Another object is to provide such a skimmer which circumscribes, together with a pool wall, a pool surface while collecting such materials so that substantially all such materials on the surface are collected.

Another object is to provide such a skimmer, adapted for use with pools of a variety of shapes and dimensions.

Another object is to provide such a skimmer which skims an entire pool surface in a single pass.

Another object is to provide a pool skimmer which has the above stated advantages and is rapid and convenient to use.

Another object is to provide such a skimmer which is easily removed from a pool when not in use and which has a compact configuration for storage.

A further object is to provide improved elements and arrangements thereof in a pool skimmer which is light in weight, economical, durable, and fully effective in carrying out its intended purposes.

DESCRIPTION OF THE PREFERRED EMBODIMENT

Figure 1:
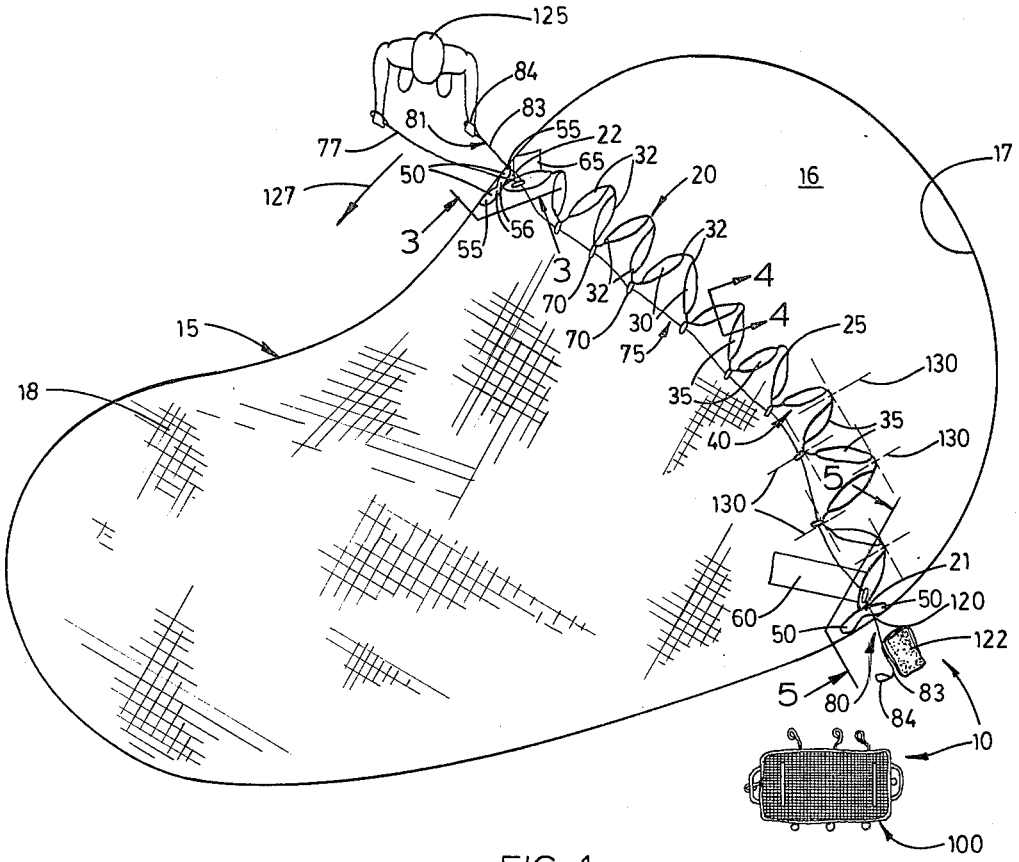
FIG. 1 is a plan view of a floating barrier and connected elements of a pool skimmer which embodies the principles of the present invention, the barrier being depicted in an extended configuration and in a representative operating environment including a pool requiring skimming.
Figure 2:
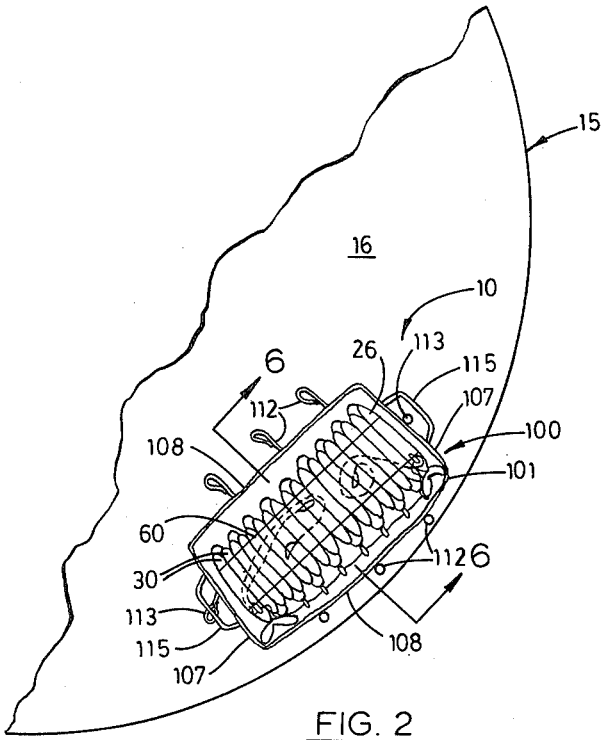
FIG. 2 is a plan view similar to FIG. 1 showing the barrier in a contracted configuration with a case of the skimmer, the case being in a receiving configuration and the environment being fragmentarily represented.

Referring with greater particularity to the drawings, in FIGS. 1 and 2 are shown a pool skimmer 10 embodying the principles of the present invention. The skimmer is depicted in FIG. 1 in a representative operating environment which includes a swimming pool 15 having a liquid surface 16 which is enclosed in circumscribing relation by a wall 17. The pool is depicted as having a typical kidney shape, however the skimmer is adapted for use with pools of a variety of other shapes. Undesired material or contaminants 18, such as a film of oil, scum, and the like, is depicted floating on the pool surface.

The skimmer 10 has an elongated, buoyant barrier 20 having an anchoring end 21, an opposite leading end 22, and a predetermined lower side 23. When floated on the surface 16 of the pool 15, the barrier is longitudinally expansible and contractible and is transversely flexible so as to assume a pleated configuration for movement between a substantially fully extended configuration 25, shown in FIG. 1, and a fully contracted or compact configuration 26, shown in FIG. 2. In the latter configuration, the barrier extends for a predetermined distance between its ends.

The barrier 20 has a plurality of rigid, elongated segments 30. These segments are of substantially equal length and extend generally longitudinally of the barrier when in its extended configuration 25. The segments correspond individually to the pleats of the barrier when in its compact configuration 26. The segments have opposite ends 32, which are spaced along the barrier in end-to-end relation, and have opposite, longitudinal sides 33. One such opposite end of one segment is at the anchoring end 21 of the barrier and is an anchoring such segment end, and another such end of another such segment is at the leading end 22 of the barrier and is a leading such segment end. The other segment ends are disposed in adjacent pairs 35 which are flexibly interconnected in a manner shortly to be described. Each such other end is thus interconnected individually and in adjacent relation to such an end of another segment so that, in the compact configuration, the two segments corresponding to each such pair of ends assume relative positions in which the segments are substantially parallel and in which the opposite longitudinally extending sides of the segments so interconnected are juxtapositioned and are substantially engaged.

Figure 3:
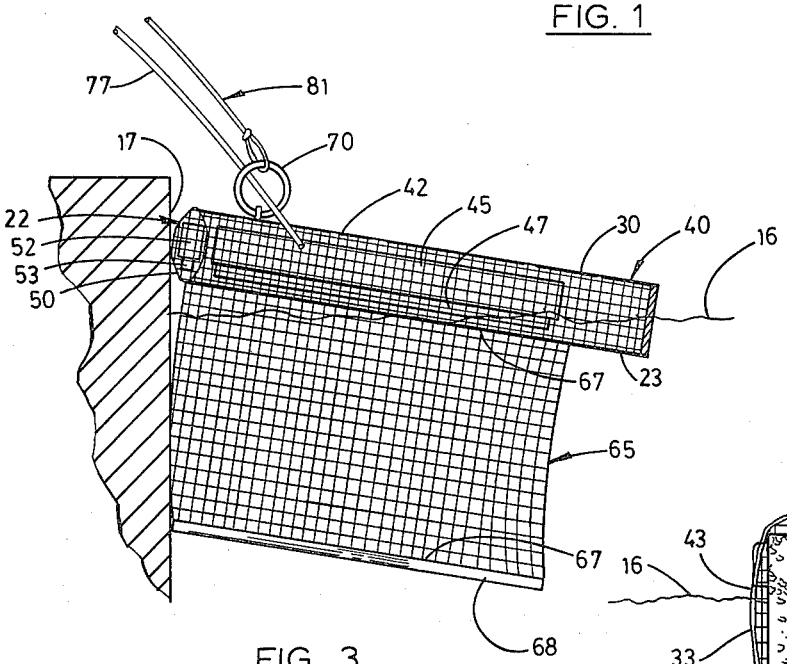
FIG. 3 is a vertical section, taken generally from the position of line 3—3 of FIG. 1 and at an enlarged scale, showing one end portion of the barrier.
Figure 4:
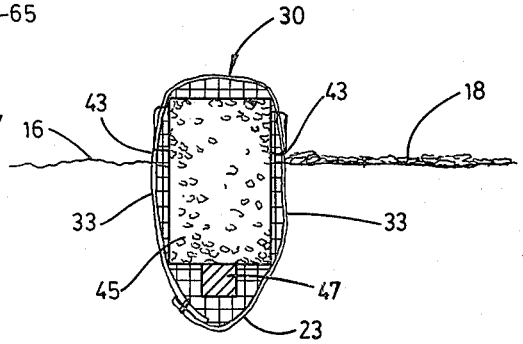
FIG. 4 is a vertical section of a segment of the barrier taken from the position of line 4—4 of FIG. 1 and at a scale further enlarged from that of FIG. 3.

The barrier 20 has an elongated, continuous, skimming tube 40 best shown in FIGS. 1, 3, and 4. The tube has a first end portion 41 at the anchoring end 21 of the barrier and has a second end portion 42 at the leading end 22 thereof. The tube has a pair of transversely opposite longitudinal sides 43. The tube is constructed of flexible netting in any suitable manner. Typically the tube is formed by folding a length of the netting along a line longitudinally of the barrier, so as to double the length to form such longitudinal sides, and by bringing the edges of the length together along the barrier lower side 23 and sewing the netting together thereat. Typically the netting is similar to that used in the prior art skimming devices described above in the Description of the Prior Art. Such netting has a mesh spacing in the order of 1.5 to 2 mm., so that the netting collects the floating material 18, including oil which is derived from body oil, hair lotion, tanning lotion or the like and which adheres to such netting. The skimming tube extends longitudinally of the barrier and is thus a portion thereof disposed so as to extend along the pool surface 16 when the barrier is floated thereon.

The barrier 20 has a plurality of rigid, elongated floats 45, corresponding individually to the segments 30. The floats are disposed within the skimming tube 40 and are aligned longitudinally with it. The floats are of any suitable construction providing sufficient rigidity to the segments and sufficient buoyancy to the barrier to support the tube at the pool surface 16 with the segments 30 extended longitudinally along the surface and extended upwardly and downwardly therefrom. Rectangular parallelopipeds of styrofoam material are well suited for use as such floats and, typically, are fixed within and upwardly of the tube by stitching through each float and the opposite netting portions adjacent thereto. It is evident that these opposite netting portions define portions of the corresponding segment which are disposed at the pool surface in contact therewith when the segment is floated on the surface. The floats are centered longitudinally of the corresponding segments so that each float has a pair of opposite ends corresponding individually to the segment ends 32. The floats are, therefore, disposed in end-to-end, spaced relation along the tube, and each adjacent pair of floats provides a pair of juxtapositioned such float ends which are individual to the floats of such adjacent pair, each such pair of float ends corresponding to one of the pairs 35 of segment ends. It is apparent from FIG. 2 that the skimming tube has a compact, pleated configuration corresponding to the compact configuration 26 of the barrier. In such configuration of the tube, the floats are substantially parallel and are disposed transversely of each other. It is evident that the portions of the tube between the float ends serve flexibly to interconnect the segments so that the barrier can assume a pleated configuration by flexing at such portions as the barrier contracts from its extended configuration 25. As best shown in FIGS. 3 and 4, the segments have individual elongated ballast weights 47, typically strips of metallic lead, which are affixed to and downwardly of the corresponding floats. The weights are dimensioned and proportioned to ballast the skimming tube so that, when the barrier is floated in the pool surface by the floats, the tube sides 43 extend upwardly and downwardly of such surface.

Figure 5:
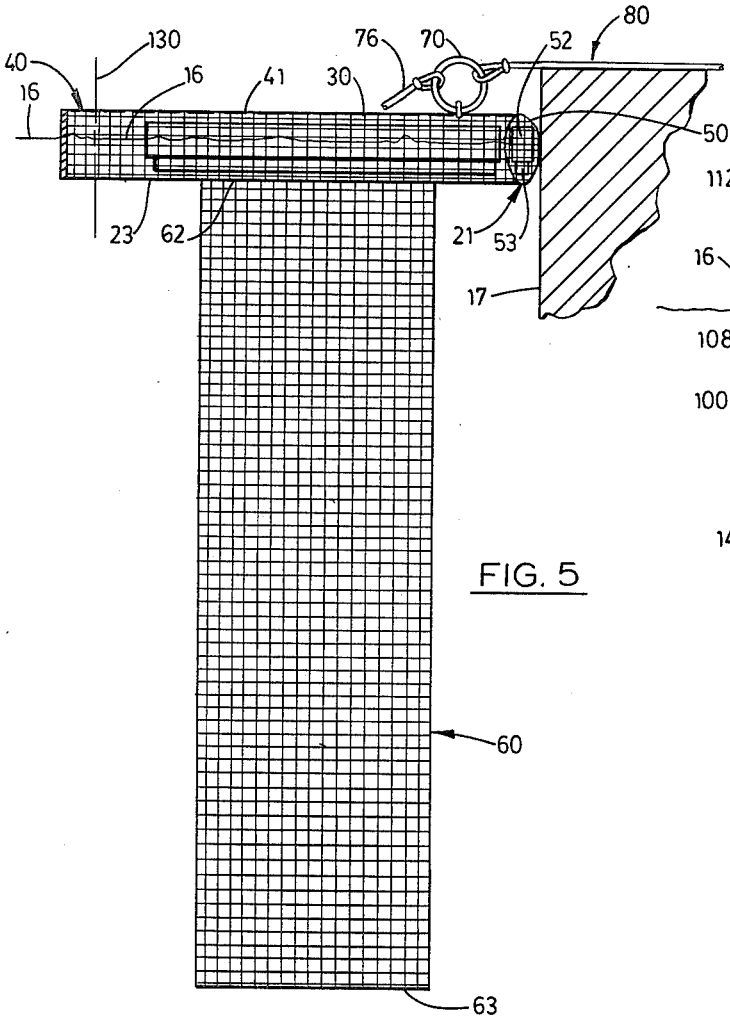
FIG. 5 is a vertical section, taken generally from the position of line 5—5 of FIG. 1 and similar to FIG. 3, showing the end portion of the barrier opposite the end portion shown in FIG. 3.

The skimmer 10 has four substantially identical sealing tubes 50, best shown in FIGS. 1, 3, and 5, one pair of such tubes being disposed at each of the ends 22 and 23 of the barrier 20. The tubes are, preferably, constructed similarly to the skimming tube 40, each sealing tube being constructed of similar netting and having a float 52 and a ballast weight 53 disposed within it and fixedly connected to it. Each sealing tube has a free end 55, typically closed by sewing, and has an opposite end 56. Such opposite end is connected, as by stitching, to the corresponding skimming tube end portion 41 or 42 and to such opposite end of the other sealing tube at the same barrier end. The sealing tubes are substantially shorter than the segments 30, but are of substantially equal thickness transversely. Each connected pair of sealing tubes and the adjacent skimming tube end portion 41 or 42 is arranged so as to assume a T-shaped configuration, best shown in FIG. 1, in which the pair of sealing tubes extend oppositely from the tube end portion.

The skimmer 10 has a closing flap 60, best shown in FIGS. 1, 2, 5 and 6, which is a length of flexible material such as the netting of which the skimming tube 40 is constructed. The flap is of elongated rectangular configuration having a width substantially less than the length of a float 52. The flap has a transversely extending fixed end 62 which is secured, as by sewing, to the tube at the lower side 23 of the barrier 20 and which extends along and centrally of the one of the segments 30 at the anchoring end 21 of the barrier. The flap has a free end 63 opposite the fixed end. The length of the flap is such that, when it is in a taut condition, the free end is spaced from the fixed end a distance substantially greater than the predetermined distance between the barrier ends 21 and 22 when the barrier is in its contracted configuration 26.

The skimmer 10 has an extension or leading end flap 65, which is best shown in FIGS. 1 and 3 and is a rectangular piece of the netting from which the skimming tube 40 is constructed. The flap has opposite edges 67 having a length approximately equal to the length of a segment 30. One of these edges is secured, as by sewing, to the tube at the bottom side 23 of the barrier 20 and extends from the leading barrier end 22 along the segment 30. The opposite edge of the leading end flap is provided with an elongated weight 68, which is similar to one of the weights 53 and extends along such opposite edge, typically being sewn thereto. It is evident that, when the barrier is floated on the pool surface 16, this flap is maintained in downwardly extended relation to the barrier by the weight.

The skimmer 10 has a plurality of loops or rings 70 which are best shown in FIGS. 1, 3, and 5 and which are mounted as by stitching, on the skimming tube 40 along a predetermined one of its sides 43. One ring is mounted adjacent to the anchoring end 21 of the barrier 20 and another ring is mounted adjacent to the leading end 22 thereof. The balance of the rings is mounted individually on alternate adjacent pairs 35 of the ends 32 of the segments 30 and are thus mounted between alternate juxtapositioned ends of the floats 45. It is apparent from FIGS. 1 and 8A through 8C, that, when the barrier is in a pleated configuration, the rings are disposed at one side of a line extending along the floats between the barrier ends. It is also apparent that the rings are mounted individually on predetermined segments for movement therewith.

The skimmer 10 has a draw cord 75 which is an elongated, flexible tension element. This cord has a fixed end 76 which is fixedly connected to the one of the rings 70 at the anchoring end 21 of the barrier 20. The fixed end is thus connected to the first end portion 41 of the skimming tube 40. The cord has, opposite its fixed end, a graspable end portion 77. The cord extends from the ring at the anchoring barrier end successively through the other rings and adjacent to the segments 30. The graspable end portion extends from the one of the rings at the leading barrier end 22 oppositely of the other rings. It is apparent that the rings, other than the anchoring end ring, serve to guide the draw cord for relatively free movement relative to the rings in a direction along the cord. It is also apparent that the rings engage the cord so that movement of the cord in a direction generally transversely of the cord motivates the rings and the segments 30 in such direction.

The skimmer 10 has a first end or anchoring cord 80 which is connected to the first end portion 41 of the skimming tube 40. The skimmer has a second end cord or leading cord 81 which is connected to the second such tube end portion 42. One end of the anchoring cord is affixed to the one of the rings 70 at the anchoring end 21 of the barrier 20, and one end of the leading cord is fixedly connected to the one of the rings at the leading end 22 of the barrier. Each of these cords has a free or graspable portion 83 which extends away from the barrier when the skimmer is being utilized to skim the surface 16 and which terminates in a loop 84 of the cord. It is evident that the free portion of the leading cord is adjacent to the graspable end portion 77 of the draw cord 75 and that the latter portion is disposed for extension from the leading barrier end toward such free portion.

Figure 7:
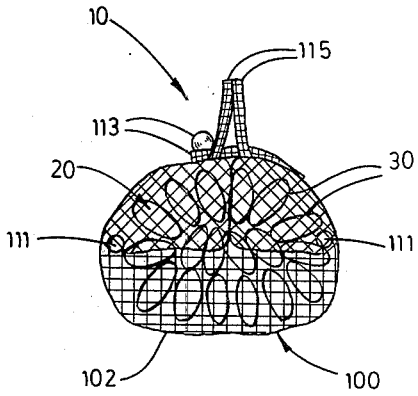
FIG. 7 is an end view of the case substantially at the scale of FIG. 6 and in a rolled configuration with the barrier within the case.
Figure 6:
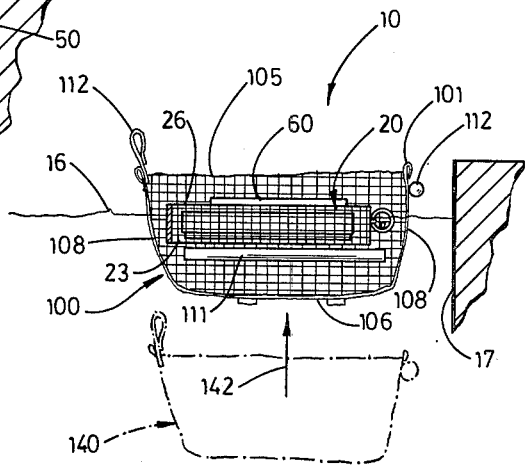
FIG. 6 is a vertical section taken from the position of line 6—6 of FIG. 2 showing the barrier received in the case, an alternate position of the case being shown in dot-dash lines.

The skimmer 10 has a case 100 best shown in FIGS. 2, 6, and 7. The case has a box-like receiving configuration 101 shown in FIGS. 2 and 6 and has a rolled configuration 102 shown in FIG. 7. In the receiving configuration, the case provides an open upper side 105, an opposite lower side 106, a pair of transverse walls 107 and a pair of longitudinal walls 108. The lower side and the walls are unitarily constructed of flexible netting substantially identical with that of which the skimming tube 40 is constructed. The bottom side is thus perforated with a plurality of openings each having a width generally equal to the mesh spacing of the skimming tube. The case is dimensioned and proportioned so that, when the barrier 20 is in its compact configuration 26, the barrier is receivable, together with the sealing tubes 50, flaps 60 and 65, rings 70, and cords 75, 80, and 81, into the case through the open side thereof with the barrier segments 30 extending between the longitudinal walls of the case. When the barrier and such other elements are within the case, the case is manipulated into its rolled configuration so that the skimmer 10 is in a convenient disposition for storage. To facilitate reception of the barrier, the case has a pair of rigid stretchers 111 individual to its transverse walls and extended therealong to hold the case open. The case has a plurality of first closures 112, typically of eye and button construction, extended between the upper edges of the transverse sides to close the open side after reception of the barrier. The case has a second closure 113, also of eye and button configuration, disposed centrally of the upper edges of the transverse walls to secure the case in its rolled configuration. The case preferably is provided with a pair of handles 115 for convenience in handling the skimmer.

OPERATION

Figure 8A:
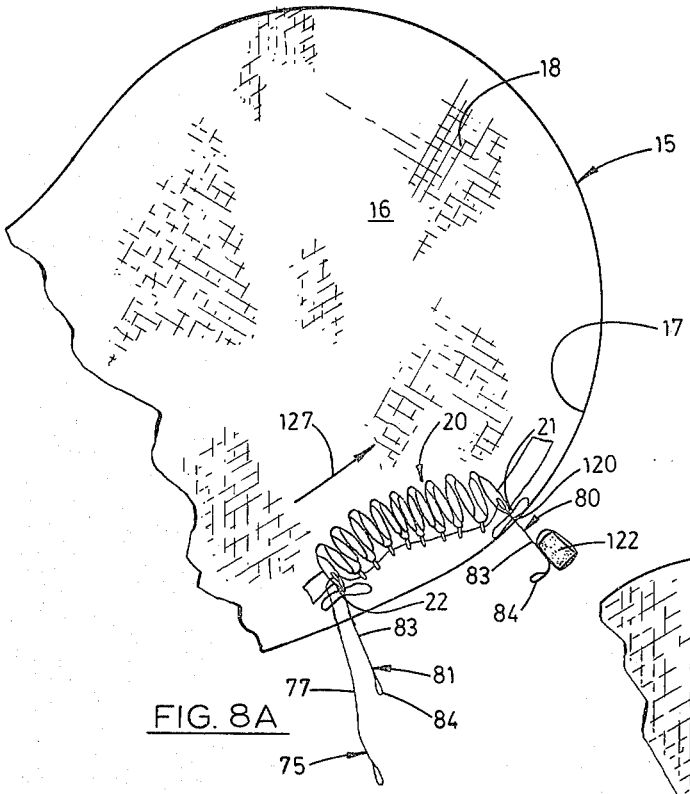
FIGS. 8A through 8C are plan views similar to FIG. 2 showing successive positions assumed by the barrier in skimming the pool.

The operation of the described embodiment of the subject invention and the method thereof are believed clearly apparent and are briefly summarized at this point. To utilize the skimmer 10 to remove the floating material 18 from the surface 16 of the pool 15, initially the barrier 20 is floated on such surface with the barrier substantially in its fully contracted configuration 26, as shown in FIG. 8A with the barrier 20 extended along the wall 17 so that the rings 70 are disposed theretoward. The flaps 60 and 65 are allowed to hang downwardly from the barrier beneath the pool surface as shown in FIGS. 3 and 5, and the cords 80 and 81 and the graspable end portions 77 of the draw cord 75 are extended from the wall 17 and away from the pool surface. The anchoring barrier end 21 is then engaged with the wall 17 at a selected location 120 therealong, and the pair of sealing tubes 50 at this end extended in opposite directions therefrom along the wall with each tube extending along the wall in a direction from its end 56 to its free end 55. The anchoring cord 80 is then grasped and drawn taut and its portion 83 connected to any suitable object 122, depicted as a block disposed alongside the pool surface, so as to anchor the anchoring end of the barrier to the wall at such selected location. The anchoring cord thus serves to engage the corresponding barrier end and the one of the segments 30 thereat with the wall.

After anchoring the barrier end 21 to the wall 17, with the barrier 20 floating on the pool surface 16 in the disposition just described in relation to the wall, the respective graspable portions 77 and 83 of the draw cord 75 and the leading cord 81 are grasped by an operator 125. Typically, these portions are grasped as shown in FIG. 1, with the draw cord in the right hand and the leading cord in the left hand while the operator stands adjacent to the pool surface and oppositely of the wall therefrom. These cord portions are thus extended from the pool surface and from the second end portion 42 of the skimming tube 40. These cord portions are then manipulated, as seen from FIG. 8B, so as to bring the leading barrier end 22 into engagement with the wall at a starting point 126 thereon at one side of the location 120 to which the anchoring end 21 is engaged, the barrier remaining substantially in its fully contracted configuration 26. The starting point, typically, is spaced from such location in a counterclockwise direction around the pool indicated by the arrows 127 in FIGS. 1 and 8A through 8C, this being the direction in which the wall is traversed by the leading barrier end to an ending point 128 which is shown in FIG. 8C and is opposite such location from the starting point. As the leading barrier end is engaged with the wall, the pair of sealing tubes 50 at this end are extended oppositely therefrom with each such tube being extended along the wall in a direction from the tube end 56 toward the tube end 55. It is evident that grasping the leading cord and drawing it away from the pool surface in a direction from the pool surface toward the wall causes the cord to extend from the leading barrier end and to urge such end and the second skimming tube end portion 42 to engage the wall. It is apparent from FIG. 8B that, when the leading barrier end is so engaged with the wall, the portion of the leading cord between the pair of the rings 70 individual to the barrier ends is disposed away from the wall.

The leading end 22 of the barrier 20 is then traversed around the wall in the direction 127, as by the operator 125 walking around the pool surface 16, to the ending point 128 so that the barrier sweeps such surface while floated thereon. The barrier thus moves from its position depicted in FIG. 8B, successively through its position shown in FIG. 1 to its position shown in FIG. 8C in which the barrier is nearly in its fully contracted configuration 26 as shown in FIG. 2. As a result, the leading end traverses the wall and moves in circumscribing relation to the pool surface while being maintained in engagement therewith by tension on the leading cord 81. As the leading barrier end traverses the wall, the barrier is motivated to move in a direction across the pool surface by tensioning the draw cord 75 and moving the graspable portion 77 thereof in such direction and along the wall. The direction of barrier movement across the pool surface changes as the barrier sweeps the pool surface, but is, in general, transversely of the portion of the draw cord between the pair of rings 70 individual to the barrier ends 21 and 22 and is toward the rings from a line extending along the longitudinal centers of the segments. The graspable portion of the draw cord is thus moved by the operator together with the leading cord, as best shown in FIG. 1, to cause the barrier to sweep across the pool surface.

As the barrier 20 is moved across the surface 16 of the pool 15 by traversing the leading barrier end 22 along the wall 17 between the points 126 and 128, it is evident that the distance between this end and the anchoring barrier end 21 varies. These changes are accommodated by relative pivotal movement of the segments 30 at the interconnected pairs 35 of the segment ends 32 about axes 130 which are shown in FIGS. 1 and 5. These axes are substantially normal to the pool surface and are disposed in individually adjacent relation to each pair of the segments corresponding to each such interconnected pair of segment ends. It is evident that such interconnected pairs of ends move together along the pool surface and that the segments pivot about the axes so that the barrier expands, contracts, and flexes in an expansible and contractible pleated arrangement to accommodate such varying distance.

Figure 8B:
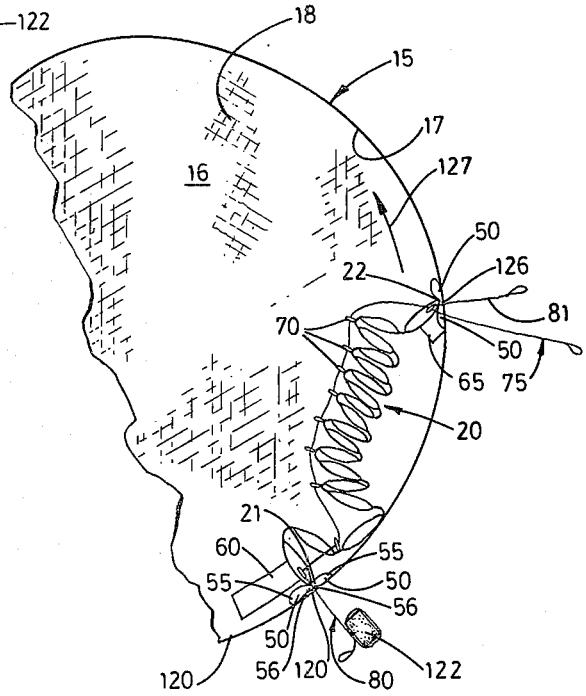
Figure 8C:
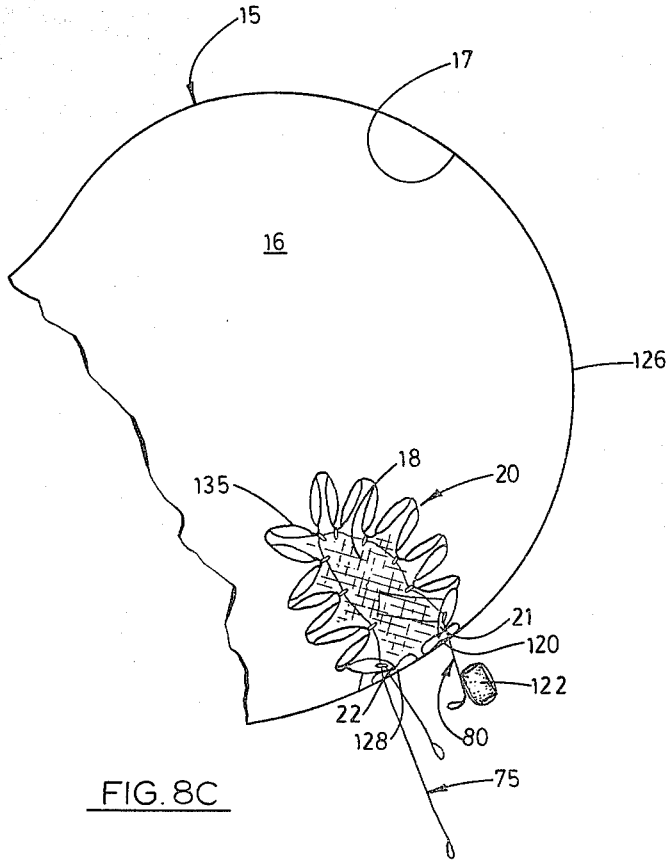

As the barrier 20 is drawn by the cord 75 across the surface 16 of the pool 15 with the barrier ends 21 and 22 engaged respectively with the wall 17 by the cords 80 and 81, the barrier passes through its successive positions shown in FIGS. 8A, 1, and 8B and collects the undesired floating material 18 on the netting of the skimming tube 40 while water passes through the netting and the barrier assumes a circumscribing configuration 135 shown in FIG. 8C about the material not yet collected. The barrier, finally, attains the fully contracted configuration 26 shown in FIG. 2 with the collected material disposed on the barrier segments. The barrier thus skims the entire pool surface in a single pass thereacross and, at all times during the pass, separates the portion of this surface which had been skimmed from the portion not yet skimmed. As a result, material from the portion not yet skimmed does not migrate, due to wind or otherwise to the portion previously skimmed and thus escape collection by the barrier. It is evident that the barrier and the wall portion, which is between the barrier ends in the direction 127 from the leading end 22 to the anchoring end 21, circumscribe the undesired material during the pass so that substantially all of the material is collected. During the pass, the sealing tubes 50, which are engaged with the wall as previously described, block escape of uncollected material between the wall and the barrier ends. During the pass, tension of the cords 75 and 81 tends to lift the leading barrier end 22 somewhat from the pool surface as depicted in FIG. 3. However, the leading end flap 65, which is extended by its weight 68 beneath the pool surface from the one of the segments 30 at this end, collects such material which would otherwise escape beneath the lower barrier side 23 at such one segment.

After the material 18 is completely collected from the pool surface 16 and the barrier 20 is in its fully contracted configuration 26 and floating on the surface as shown in FIGS. 2 and 6, the cord 80 is detached from the object 122 and this cord and the cords 75 and 81 are coiled and placed on top of the barrier segments 30. The closing flap 60 is then brought upwardly from the pool surface and around the one of the segments 30 at the barrier anchoring end 21, the end to which this flap is attached along the fixed end 62 thereof. The closing flap is next extended in draped relation across and upwardly of the cords and the barrier with the free end 63 of this flap extended downwardly into the pool surface from the segment at the leading barrier end 22. When so draped, the closing flap retains the floating barrier in its fully contracted configuration for the time being.

The case 100 is then placed in its receiving configuration 101 and submerged beneath the surface 16 of the pool 15 in a disposition 140, which depicted in dot-dash lines in FIG. 6 and in which the case is at a depth such that its upper side 105 is disposed downwardly of the floating barrier 20 and of the flaps 60 and 65 and the cords 75, 80 and 81 which are attached to the barrier. The case is then placed beneath the barrier with the open side of the case upwardly disposed, and the case is lifted upwardly, as indicated by the arrow 142, so that the barrier and such attached elements are received within the case through its open side and rest on its lower side 106. Continued upward movement of the case to a position above the surface lifts the barrier, including the skimming tube 40 and the formerly floating material 18 collected thereon. As the barrier is lifted from the surface, any such collected material, which becomes disengaged from the barrier, is caught by the netting of the case while water draining from the barrier and attached elements passes through the openings of this netting. The case, the barrier, and the other elements of the skimmer 10 are then moved, typically by the handles 115, to a location, not shown, spaced substantially from the pool surface. At such location the barrier and the case are thoroughly rinsed in any suitable manner to remove the collected material. The skimmer is then dried and the barrier and attached elements stored as shown in FIG. 7, with the case in the rolled disposition 102.

Although the invention has been shown and described in what is conceived to be the most practical and preferred method and apparatus, it is recognized that departures may be made therefrom within the scope of the invention, which is not to be limited to the illustrative details disclosed.

Having described my invention, what I claim as new and desire to secure by Letters Patent is:

1. A pool skimmer for collecting undesired floating material from a liquid surface bounded by a wall, the skimmer comprising:

A. an elongated, buoyant barrier which is longitudinally expansible and contractible and is transversely flexible, the barrier having opposite ends and having a portion which is constructed of netting and is disposed so as to extend along the surface when the barrier is floated therein;

B. means individual to each such end for engaging its respective end with the wall;

C. graspable means for drawing one such end along the wall and in circumscribing relation to a portion of the surface so that the barrier moves across the surface to collect to material;

D. wherein the barrier has a plurality of rigid segments spaced therealong in end-to-end relation and interconnected by portions of such netting so that the barrier assumes a pleated configuration by flexing at such portions as the barrier contracts from a fully extended configuration;

E. wherein the barrier has a plurality of loop means fixedly mounted on alternate such portions of the netting so that the loop means are disposed at one side of a line extended along the segments between the opposite ends of the barrier when the barrier is in such pleated configuration and wherein the graspable means comprises a draw cord extended through each such loop means and having opposite end portions, so that drawing the cord by one of such opposite end portions in a direction generally from such line toward such loop means motivates the barrier across the liquid surface;

F. wherein the means for engaging with the wall the end of the barrier opposite said one end thereof is adapted to fix such opposite end of the barrier at a selected location along the wall, and wherein one end portion of the draw cord is fixedly connected to such opposite end of the barrier so that, by drawing the other end portion of the cord in a direction across the pool surface, the barrier is motivated to move thereacross and collect the material; and G. wherein the means for engaging said one end of the barrier with the wall comprises a cord having an end portion fixedly connected to such opposite end of the barrier and having an opposite, graspable end portion.

2. A pool skimmer for collecting floating material from a liquid having a surface enclosed by a wall, the skimmer comprising A. a plurality of rigid elongated segments, each segment having a pair of opposite ends and means for buoyantly supporting the segment in the liquid with the segment extended along such surface and extended upwardly and downwardly therefrom, one end of one segment being a predetermined leading end and one end of another segment being a predetermined anchoring end;

B. means for interconnecting each such end, other than the leading end and the anchoring end, individually and in adjacent relation to such an end of another segment so that, when the segments float in the liquid, the pairs of ends so interconnected move together along such surface and the pairs of segments corresponding to such interconnected pairs move pivotally about axes which are individually adjacent to each such interconnected pair and which are substantially normal to such surface;

C. means connected to the anchoring end for fixing such another segment to the wall at a selected location therealong with the anchoring end engaged with the wall;

D. graspable means connected to the leading end for drawing such end into engagement with the wall and for traversing such end therealong from a starting point, which is adjacent to such location and is at one side thereof, to an ending point, which is adjacent to such location and is opposite thereof from the starting point, so that the segments are motivated across such surface to collect such floating material and to assume a circumscribing relation thereabout as the leading end attains the ending point, the segments pivoting about such axes in an expansible and contractible pleated arrangement to accommodate varying distances between the anchoring end and the leading end as the leading end traverses the wall;

E. elongated, flexible tension means having a graspable end portion and having an opposite end portion which is fixedly connected to such anchoring end, the tension means extending adjacent to the segments from the anchoring end to the leading end and the graspable end portion being disposed for extension from the leading end toward said graspable means; and F. a plurality of loop means, which are mounted individually on predetermined such segments so as to move therewith, for guiding such tension means in relatively free movement relative to the loop means in a direction along such tension means and for engaging such tension means so as to motivate the loop means and the segments in a direction generally transversely of such tension means when the graspable end portion thereof is moved with said graspable means as the graspable means traverse the leading end along the wall.

3. The skimmer of claim 2 wherein the floating material includes oil; wherein each segment has a portion disposed at such surface in contact therewith when the segment floats in the liquid; and wherein such portion is constructed of netting having a mesh spacing such that such floating oil is collected by the netting.

4. A pool skimmer for use with a liquid surface, the skimmer comprising

A. an elongated skimming tube constructed of flexible netting, the tube having a first end portion and an opposite second end portion;

B. a plurality of elongated, rigid floats affixed within the skimming tube and aligned longitudinally therewith, each float having a pair of opposite ends, and the floats being adapted buoyantly to support the tube at the surface and being disposed in end-to-end relation so that each adjacent pair of floats provides a pair of such ends which are juxtapositioned and which are individual to the floats of each such adjacent pair;

C. means for ballasting the skimming tube so that a predetermined side thereof extends upwardly and downwardly of the liquid surface when the tube is floated thereon by the floats;

D. a plurality of loops fixedly mounted on such predetermined side of the skimming tube individually between alternate such juxtapositioned pairs of ends so that, when the tube is floated on the liquid surface by the floats and is flexed transversely in opposite directions between alternate adjacent floats, the tube assumes a pleated configuration with the loops disposed at one side of a line extending along the floats and between the end portions of the tube;

E. first tube end means connected to the first end portion of the skimming tube for anchoring the first end portion against the wall in engagement with the wall at a selected location therealong;

F. second tube end means connected to the second end portion of the skimming tube and extended therefrom for grasping to urge the second end portion into engagement with the wall;

G. a cord having one end and having a graspable portion spaced therefrom, such one end being fixedly connected to the first end portion of the skimmer tube, and the cord extending from such one end thereof successively through the loops so that the graspable end portion is adjacent to the second tube end means and so that movement of the graspable portion along the wall, with the first end portion of the tube urged thereagainst and with the tube floated on the liquid surface, draws the tube along the surface in a direction from such a line toward the loops.

5. The skimmer of claim 4 wherein said netting has a predetermined mesh spacing such that oil floating on the liquid surface is collected by the skimming tube as the tube is drawn therealong; wherein the tube has a compact pleated configuration in which the floats are substantially parallel and are disposed transversely of each other; and wherein the skimmer further comprises a case adapted to receive the tube when the tube is in such compact configuration, the case having an open side and having an opposite side perforated with a plurality of openings each having a width generally equal to such mesh spacing, so that, when the tube is in such compact configuration and is floating on the surface, the skimming tube is liftable from the liquid surface together with oil collected by the tube by submerging the case beneath the tube with such open side upwardly disposed and by moving the case upwardly so that the tube is received therein through such open side and rests on such opposite perforated side.

6. The skimmer of claim 4 wherein the skimmer is adapted to skim undesired floating material from such liquid surface and further comprises a sealing member and a float connected thereto, the sealing member being constructed of flexible netting and having a free end and an opposite end which is connected to one of the end portions of the skimming tube so that, when such one end portion is engaged with the wall and the sealing member is extended therealong in a direction between such free end and such opposite end, the sealing member blocks escape of the undesired material between the wall and such one portion.

7. A pool skimmer for collecting floating material from a liquid having a surface and being enclosed by a wall, the skimmer comprising A. an elongated, buoyant, flexible, longitudinally extendible and contractible barrier having a predetermined leading end and a predetermined anchoring end;

B. means connected to the anchoring end for anchoring the anchoring end to the wall at selected locations therealong;

C. graspable means connected to the leading end for drawing such end into engagement with the wall and for traversing such end therealong from a starting point, which is adjacent to such location and is at one side thereof, to an ending point, which is adjacent to such location and is opposite thereof from the starting point, so that the barrier is motivated across such surface to collect such floating material and to assume a circumscribing relation thereabout as the leading end approaches the ending point;

D. elongated, flexible tension means having a graspable end portion and having an opposite end portion which is fixedly connected to such anchoring end, the tension means extending adjacent to the segments from the anchoring end to the leading end and the graspable end portion being disposed for extension from the leading end toward said graspable means; and E. a plurality of loops mounted in successibly spaced relation along the barrier having the flexible tension means threaded therethrough so as to move therewith whereby the tension means is guided relative to the loops in a direction along such tension means and for engaging such tension means so as to motivate the loops in a direction generally transversely of such tension means when the graspable end portion thereof is moved with said graspable means as the graspable means traverses the leading end along the wall.

* * * * *

UNITED STATES PATENT AND TRADEMARK OFFICE

CERTIFICATE OF CORRECTION

PATENT NO. : 4,472,842

DATED : September 25, 1984

INVENTOR(S) : Anna M. Jarrett

It is certified that error appears in the above-identified patent and that said Letters Patent is hereby corrected as shown below:

Column 9, line 64, delete "to" (second instance) and substitute ---the---.

Signed and Sealed this

*Sixteenth* Day of *April 1985*

[SEAL]

*Attest:*

DONALD J. QUIGG

*Attesting Officer*

*Acting Commissioner of Patents and Trademarks*